US008894191B2

(12) United States Patent
Moscato et al.

(10) Patent No.: US 8,894,191 B2
(45) Date of Patent: Nov. 25, 2014

(54) APPARATUS AND METHOD FOR DISPOSING INKJET CARTRIDGES IN A CARRIER

(71) Applicant: R. R. Donnelley & Sons Company, Chicago, IL (US)

(72) Inventors: Anthony V. Moscato, Grand Island, NY (US); Theodore F. Cyman, Jr., Grand Island, NY (US); Dan E. Kanfoush, Grand Island, NY (US); John R. Soltysiak, Blasdell, NY (US)

(73) Assignee: R. R. Donnelley & Sons, Inc., Chicago, IL (US)

( * ) Notice: Subject to any disclaimer, the term of this patent is extended or adjusted under 35 U.S.C. 154(b) by 0 days.

(21) Appl. No.: 13/829,027

(22) Filed: Mar. 14, 2013

(65) Prior Publication Data

US 2013/0194358 A1 Aug. 1, 2013

Related U.S. Application Data

(63) Continuation-in-part of application No. PCT/US2012/050403, filed on Aug. 10, 2012.

(60) Provisional application No. 61/523,079, filed on Aug. 12, 2011.

(51) Int. Cl.
*B41J 2/175* (2006.01)
*B41J 2/14* (2006.01)

(52) U.S. Cl.
CPC ..... *B41J 2/17526* (2013.01); *B41J 2/17509* (2013.01); *B41J 2/14* (2013.01); *B41J 2/1752* (2013.01); *B41J 2202/19* (2013.01)
USPC ..... 347/87; 347/40; 347/84; 347/85

(58) Field of Classification Search
CPC .... B41J 2/175; B41J 2/17506; B41J 2/17509; B41J 2/1752; B41J 2/17533; B41J 2/1754; B42J 2/17503
See application file for complete search history.

(56) References Cited

U.S. PATENT DOCUMENTS

| | | | |
|---|---|---|---|
| 4,025,925 | A | 5/1977 | Jensen et al. |
| 4,288,799 | A | 9/1981 | Uzawa et al. |
| 4,531,828 | A | 7/1985 | Hoshino |

(Continued)

FOREIGN PATENT DOCUMENTS

| | | |
|---|---|---|
| EP | 677 387 | 10/1995 |
| JP | A-2004-255335 | 9/2004 |
| WO | WO 2007/092488 | 8/2007 |

OTHER PUBLICATIONS

International Search Report and Written Opinion in PCT/US2007/003238 dated Nov. 12, 2008.

*Primary Examiner* — Juanita D Jackson
(74) *Attorney, Agent, or Firm* — McCracken & Gillen LLC

(57) ABSTRACT

A system and method for applying fluid to a receiver surface are disclosed. A carrier has a top surface, a bottom surface, and a slot, wherein the bottom surface of the carrier faces the receiver surface. A mount is positioned in the slot, an inkjet cartridge is disposed in the mount, and fluid is ejected from the inkjet cartridge toward the receiver surface. The inkjet cartridge is disposed such that at least a portion of the inkjet cartridge extends inwardly from the bottom surface of the carrier.

24 Claims, 5 Drawing Sheets

(56) References Cited

U.S. PATENT DOCUMENTS

| | | | |
|---|---|---|---|
| 4,617,574 | A | 10/1986 | Millet et al. |
| 4,709,246 | A | 11/1987 | Piatt et al. |
| 4,709,247 | A | 11/1987 | Piatt et al. |
| 4,755,836 | A | 7/1988 | Ta et al. |
| 4,785,734 | A | 11/1988 | Kawana et al. |
| 4,812,859 | A | 3/1989 | Chan et al. |
| 4,878,063 | A | 10/1989 | Katerberg |
| 5,057,854 | A | 10/1991 | Pond et al. |
| 5,059,984 | A | 10/1991 | Moore et al. |
| 5,111,220 | A | 5/1992 | Hadimioglu et al. |
| 5,121,130 | A | 6/1992 | Hempel et al. |
| 5,192,959 | A | 3/1993 | Drake et al. |
| 5,241,325 | A | 8/1993 | Nguyen |
| 5,289,208 | A | 2/1994 | Haselby |
| 5,365,847 | A | 11/1994 | Pers |
| 5,376,958 | A | 12/1994 | Richtsmeier et al. |
| 5,408,746 | A | 4/1995 | Thoman et al. |
| 5,428,375 | A | 6/1995 | Simon et al. |
| 5,461,405 | A | 10/1995 | Lehmann et al. |
| 5,469,199 | A | 11/1995 | Allen et al. |
| 5,630,106 | A | 5/1997 | Ishibashi |
| 5,751,303 | A | 5/1998 | Erickson et al. |
| 5,765,481 | A | 6/1998 | Tortora et al. |
| 5,782,184 | A | 7/1998 | Albertalli et al. |
| 5,793,397 | A | 8/1998 | Barker et al. |
| 5,796,411 | A | 8/1998 | Cyman et al. |
| 5,797,305 | A | 8/1998 | Harrod et al. |
| 5,806,430 | A | 9/1998 | Rodi |
| 5,808,635 | A | 9/1998 | Kneezel et al. |
| 5,838,343 | A | 11/1998 | Chapin et al. |
| 5,946,011 | A | 8/1999 | Kanaya |
| 5,949,438 | A | 9/1999 | Cyman et al. |
| 6,003,988 | A | 12/1999 | McCann et al. |
| 6,065,400 | A | 5/2000 | Van Weverberg |
| 6,068,367 | A | 5/2000 | Fabbri |
| 6,120,142 | A | 9/2000 | Eltgen et al. |
| 6,213,580 | B1 | 4/2001 | Segerstrom et al. |
| 6,224,192 | B1 | 5/2001 | Robinson et al. |
| 6,234,605 | B1 | 5/2001 | Hilton |
| 6,250,738 | B1 | 6/2001 | Waller et al. |
| 6,253,678 | B1 | 7/2001 | Wentworth |
| 6,298,783 | B1 * | 10/2001 | O'Mera et al. ..... 101/486 |
| 6,299,287 | B1 | 10/2001 | Williams et al. |
| 6,302,517 | B1 | 10/2001 | Kanaya |
| 6,336,722 | B1 | 1/2002 | Wotton et al. |
| 6,375,296 | B1 | 4/2002 | McGarry et al. |
| 6,386,668 | B1 | 5/2002 | Shimizu et al. |
| 6,422,678 | B1 | 7/2002 | Serra et al. |
| 6,450,607 | B1 | 9/2002 | Bolash et al. |
| 6,457,810 | B1 | 10/2002 | King et al. |
| 6,460,441 | B1 | 10/2002 | Harrod |
| 6,467,874 | B1 | 10/2002 | Williams |
| 6,471,335 | B1 | 10/2002 | Gelbart |
| 6,592,200 | B2 | 7/2003 | Wotton et al. |
| 6,592,276 | B2 | 7/2003 | Ohba et al. |
| 6,637,860 | B1 | 10/2003 | Madeley |
| 6,688,721 | B1 | 2/2004 | Serra |
| 6,755,513 | B1 | 6/2004 | Silverbrook et al. |
| 6,789,876 | B2 | 9/2004 | Barclay et al. |
| 6,789,879 | B2 | 9/2004 | Khalid |
| 6,830,315 | B2 | 12/2004 | Silverbrook et al. |
| 6,890,061 | B1 | 5/2005 | Freire et al. |
| 7,073,882 | B2 | 7/2006 | Kim et al. |
| 7,083,255 | B2 | 8/2006 | Shibata et al. |
| 7,093,926 | B2 | 8/2006 | Gil |
| D537,115 | S | 2/2007 | Hirota et al. |
| 7,182,434 | B2 | 2/2007 | Silverbrook et al. |
| D539,338 | S | 3/2007 | Hirota et al. |
| 7,240,993 | B2 | 7/2007 | Silverbrook et al. |
| 7,431,428 | B2 | 10/2008 | Yamada |
| 7,690,761 | B2 | 4/2010 | Silverbrook et al. |
| 7,771,010 | B2 * | 8/2010 | Moscato et al. ..... 347/40 |
| 2005/0140722 | A1 | 6/2005 | Shibata et al. |
| 2005/0270329 | A1 | 12/2005 | Hoisington et al. |
| 2006/0008296 | A1 | 1/2006 | Sampe et al. |
| 2010/0177144 | A1 | 7/2010 | Silverbrook et al. |
| 2010/0201745 | A1 | 8/2010 | Silverbrook |

* cited by examiner

APPARATUS AND METHOD FOR DISPOSING INKJET CARTRIDGES IN A CARRIER

CROSS REFERENCE TO RELATED APPLICATIONS

The present application is a continuation-in-part of International Application No. PCT/US2012/50403, with an international filing date of Aug. 10, 2012, which in turn claims benefit of Moscato et al., Provisional U.S. Patent Application Serial No. 61/523,079, filed on Aug. 12, 2011. The entire contents of both of these applications are incorporated herein by reference.

BACKGROUND OF THE INVENTION

1. Field of the Invention

The present application relates generally to inkjet printing systems and methods and more particularly to a system and method for disposing inkjet cartridges in a carrier used in such systems.

2. Description of the Background of the Invention

High-speed printing systems typically include one or more imaging units. Each imaging unit has one or more inkjet cartridges (or printheads). A controller controls each inkjet cartridge to eject a fluid (such as ink or other composition) onto a receiving surface. Some printing systems use an imaging unit with a moving inkjet cartridge (or an array of inkjet cartridges) that traverses the width of the receiving surface as nozzles of the inkjet cartridge drop one or more lines of fluid to form a swath of an image along the width of the receiving surface. Upon completion of the swath, the receiving surface is advanced in accordance with the width of the swath and the inkjet cartridge again traverses the width of the receiving surface to print a next swath of the image.

Other printing systems use an image unit with a fixed inkjet cartridge (or an array of inkjet cartridges) in which the receiving surface is moved under the inkjet cartridge and nozzles of the inkjet cartridge eject drops of fluid onto the receiving surface in accordance with the position of the receiving surface to print an image. Inkjet cartridges are interfaced with a controller that controls the formation and ejection of drops from the inkjet cartridge when such drops are needed. In addition, inkjet cartridges may be connected using fluid conduits to ink supplies that provide ink and/or other fluids to the inkjet cartridge to replenish any ink ejected and/or otherwise removed (e.g., by evaporation) therefrom.

In a printing system, an inkjet cartridge is secured to a carrier and disposed such that the nozzles of the inkjet cartridge are directed toward the receiving surface. The carrier may be manufactured from steel or other alloys that can be milled to a high precision. More than one inkjet cartridge may be secured to a carrier in this fashion in a one or two-dimensional array. Some inkjet cartridges may need to be mounted so that, when a drop is ejected, the angle between the plane of the face of the inkjet cartridge directed toward the receiving surface and the plane of the portion of the receiving surface on which such drop is deposited is within a predetermined range. In addition, the distance between the face of the inkjet cartridge and the receiving surface may also need to be within a predetermined range.

Further, inkjet cartridges may need to be disposed on a carrier such that a sufficient amount of the carrier material remains between cartridges so that the structural integrity of the carrier is not compromised. Further, the inkjet cartridges may need to be disposed on a carrier so that there is sufficient space available to secure one or more data cables, fluid conduits, and/or circuitry to the inkjet cartridge disposed.

SUMMARY OF THE INVENTION

According to one aspect of the invention, a system for applying fluid to a receiver surface includes a carrier having a top surface, a bottom surface, and a slot, wherein the bottom surface of the carrier faces the receiver surface, The system also includes a mount positioned in the slot, an inkjet cartridge disposed in the mount, and a controller for causing the inkjet cartridge to eject fluid toward the receiver surface. At least a portion of the inkjet cartridge extends inwardly from the bottom surface of the carrier.

According to another aspect of the invention, a method of printing on a receiver surface includes the steps of providing a carrier having a top surface, a bottom surface, and a slot, wherein the bottom surface of the carrier faces the receiver surface, The method includes the additional steps of positioning a mount in the slot, disposing an inkjet cartridge in the mount, and operating the inkjet cartridge to eject a fluid toward the receiver surface. The inkjet cartridge is disposed such that at least a portion of the inkjet cartridge extends inwardly from the bottom surface of the carrier.

Other aspects and advantages will become apparent upon consideration of the following detailed description.

DETAILED DESCRIPTION OF THE PREFERRED EMBODIMENTS

Figure 1:
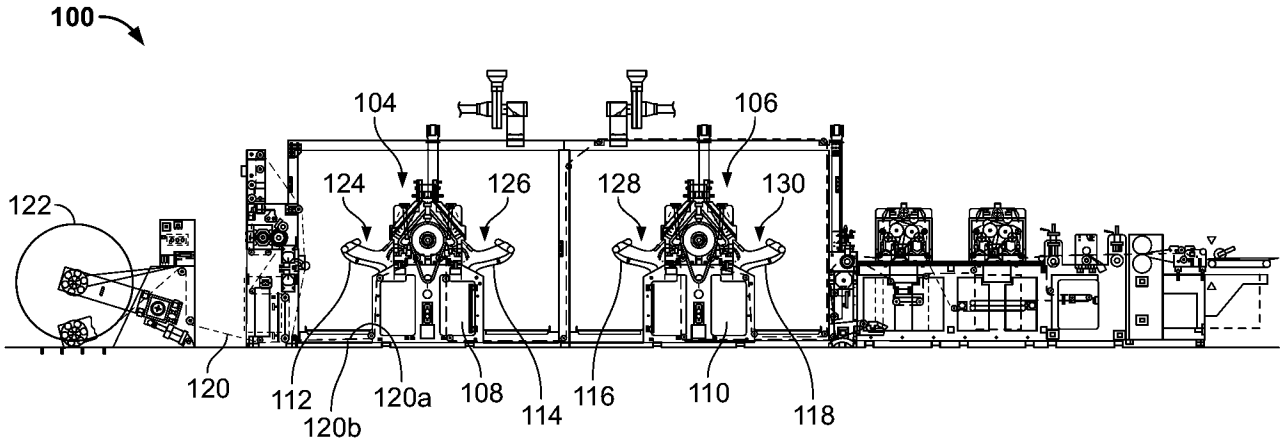
FIG. 1 is a side elevational view with portions removed of a printing system of the present disclosure.

Referring to FIG. 1, a printing system 100 that includes a first imaging unit 104, a second imaging unit 106, a first dryer 108, and a second dryer 110. In the printing system 100, the imaging unit 104 includes carriers 112 and 114 onto which inkjet cartridges may be secured, Similarly, the second imaging unit 106 includes carriers 116 and 118 onto which inkjet cartridges may be secured. The carriers 112, 114, 116, and 118 are shown in an open, non-printing position in FIG. 1. A receiving surface 120 may be transported through the printing system 100 such that the first imaging unit 104 prints ink(s) on a front side 120*a* and the second imaging unit 106 prints ink(s) on the reverse side 120*b* thereof. The receiving surface 120 may comprise a web, sheet, or belt of paper or other material, as desired. In the illustrated embodiment, a web of paper from a roll 122 is supplied to the imaging units 104, 106.

In the printing system 100 of FIG. 1, each print unit 104 and 106 has leading and trailing portions, In particular, the print unit 104 has a leading portion 124 at which the carrier 112 is disposed and a trailing portion 126 at which the carrier 114 is disposed. Similarly, the print unit 106 has leading and trailing portions 128 and 130 at which carriers 116 and 118 are disposed, respectively.

Figure 2B:
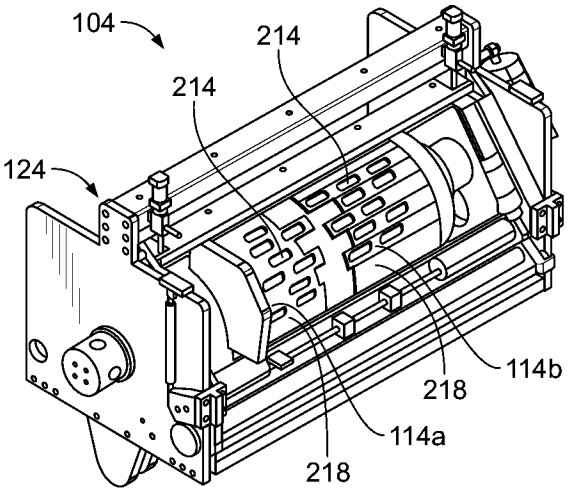
FIGS. 2A and 2B are isometric views of an imaging unit of the printing system of FIG. 1.
Figure 2A:
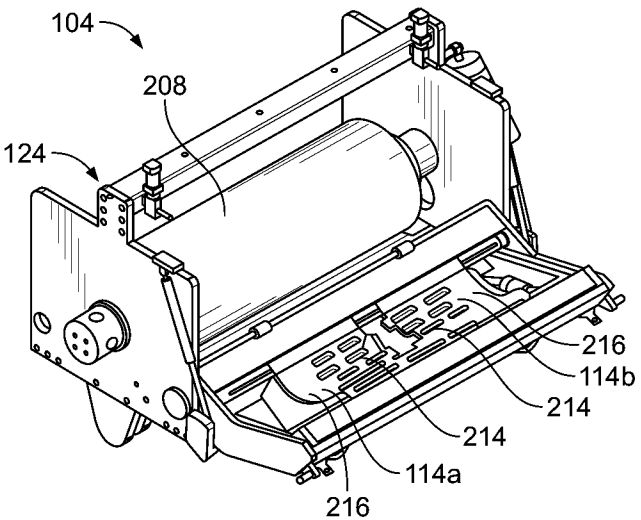

The dryers 108 and 110 may be used to dry ink(s) or other fluids deposited by the inkjet cartridges of the first and second imaging units 104 and 106, respectively, Referring to FIGS. 2A and 2B, an embodiment of the imaging unit 104 includes a drum 208 and carriers 114*a* and 114*b*. FIG. 2A shows the carriers 114 in an open, non-printing position and FIG. 2B shows the carriers 114 in a closed, printing position. The carrier 114 includes apertures in the form of slots 214 into each of which an inkjet cartridge may be disposed and secured by a mount (described hereinafter). During operation, the receiving surface 120 is transported about the drum 208. In some embodiments, a motor drives the drum 208 so that rotation of the drum 208 assists in transporting the receiving surface 120.

The inkjet cartridges (not shown) disposed in the slots 214 of the carriers 114*a* and 114*b* print on the same side of the receiving surface. The slots 214 are arranged in the carriers 114*a* and 114*b* in a two-dimensional pattern. The inkjet cartridges disposed on the slots 214 of the carriers 114*a* and 114*b* print, for example, on the left-hand and right-hand portions, respectively, of a side 120*a* of the receiving surface 120. It should be apparent that the carriers 114*a* and 114*b* may be replaced by a single carrier or three or more carriers, wherein the single or multiple carriers together or individually span a width similar or identical to the combined width of the carriers 114*a* and 114*b*. Additional inkjet cartridges are mounted on carriers (not shown) similar or identical to the carriers 114*a* and 114*b* that are disposed on or adjacent the other portion 214 of the imaging unit 104. Each carrier 114*a* and 114*b* has a bottom surface 216 and a top surface 218. In the closed position, the bottom surfaces 216 face toward the drum 208, and therefore, toward the receiving surface 120 transported about such drum 208, and the top surfaces face away from the drum 208 and the receiving surface 120. As seen in FIG. 2B, in the closed position, nozzles of the inkjet cartridges disposed in slots 214 face the drum 208 and the receiving surface 120, and the receiving surface 120 is transported between the drum 208 and such nozzles.

In some embodiments in which the fluid is ink, the imaging unit 104 may print using two colors of ink, for example, a black ink and a spot or process color ink. In such an embodiment, each inkjet cartridge secured to the carrier 112 may, for example, print black ink and each inkjet cartridge secured to the carrier 114 may, for example, print red ink. Alternately, each inkjet cartridge secured to the carriers 112 and 114 may print cyan and magenta ink, respectively, and each inkjet cartridge secured to the carriers 116 and 118 may print yellow and black inks, respectively. In such embodiments, the two imaging units 104 and 106 may be used to print a four-color image onto one side of the receiving surface 120.

In other embodiments of the printing system 100, inkjet cartridges that can each print two ink colors (or two types of fluids) may be used. In such embodiments, each inkjet cartridge secured to the carrier 112 may print, for example, cyan and magenta ink and each inkjet cartridge secured to the carrier 114 may print, for example, yellow and black ink, In these embodiments, one imaging unit 104 may be used to print a four-color image on one side of the receiving surface 120. As should be apparent, inkjet cartridges that can each print one or more colors may be used in any combination on the carriers 112 and 114. Further, the inkjet cartridges disposed on the carriers 112 and 114 may print identical colors. As should be apparent the carriers 112 and 114 need not be of identical size and that either or both carriers may be replaced by a single or more than two carriers.

Figure 3A:
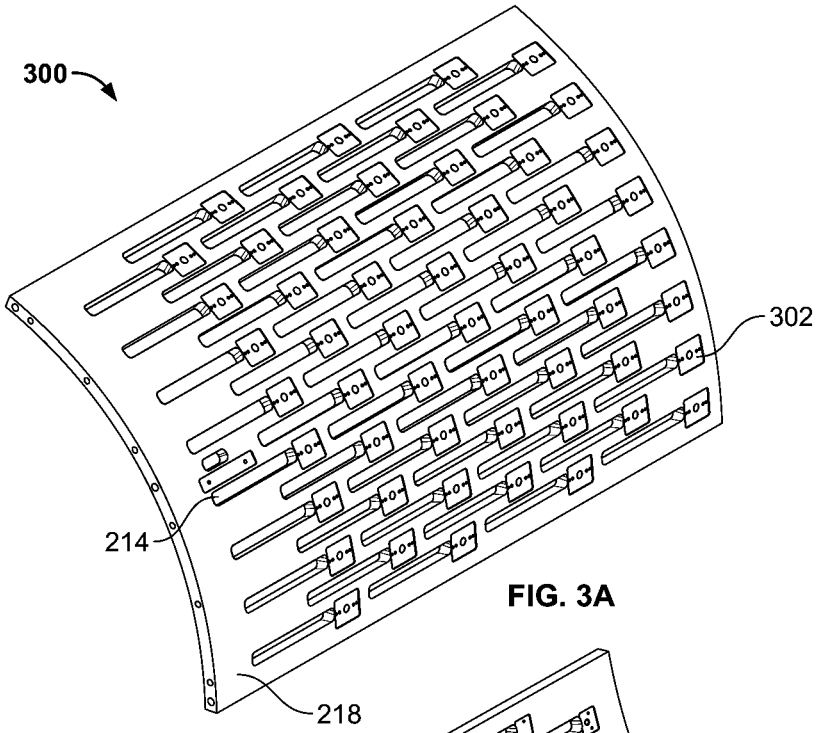
FIGS. 3A and 3B are isometric views of a top and bottom surface of a carrier, respectively, of the printing system of FIG. 1.
Figure 3B:
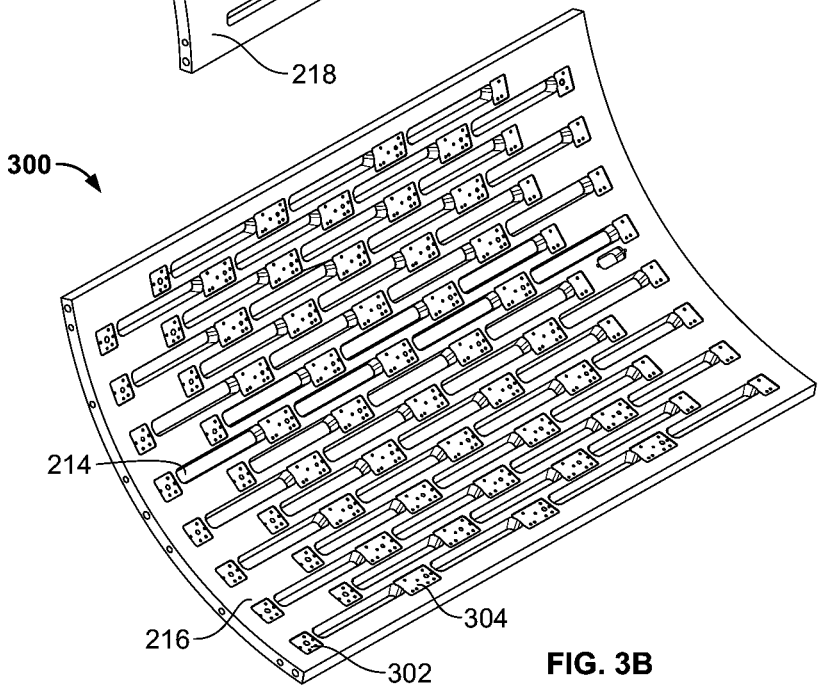

Referring to FIGS. 3A and 3B, the carrier 300 includes a top surface 218 and a bottom surface 216. The pattern in which the slots 214 are arranged in the carrier 300 is different than the pattern in which the slots 214 are arranged in the carriers 114*a* and 114*b*. It should be apparent that the slots 214 may be arranged in other two-dimensional patterns.

The carrier 300 includes additional apertures 302 through which elements of a mount (not seen in FIGS, 3A and 3B) secured into a slot 214 may extend into and/or pass through. The apertures 302 may also be used to accommodate one or more screws that secure the mount to the carrier 300. The carrier 300 may include additional indents or screw holes 304 that may be used to secure the mount to the carrier 300 and/or provide datum surfaces that aid in aligning the mount with respect to the slot 214 in the carrier 300. As should be apparent, the carrier 300 may be an arcuate plate or a flat plate.

Provisional U.S. Patent Application Ser. No. 61/535,150, filed on Sep. 23, 2011, is directed to a mount in which an inkjet cartridge may be disposed and the entire contents of this application are incorporated herein by reference.

Figure 4A:
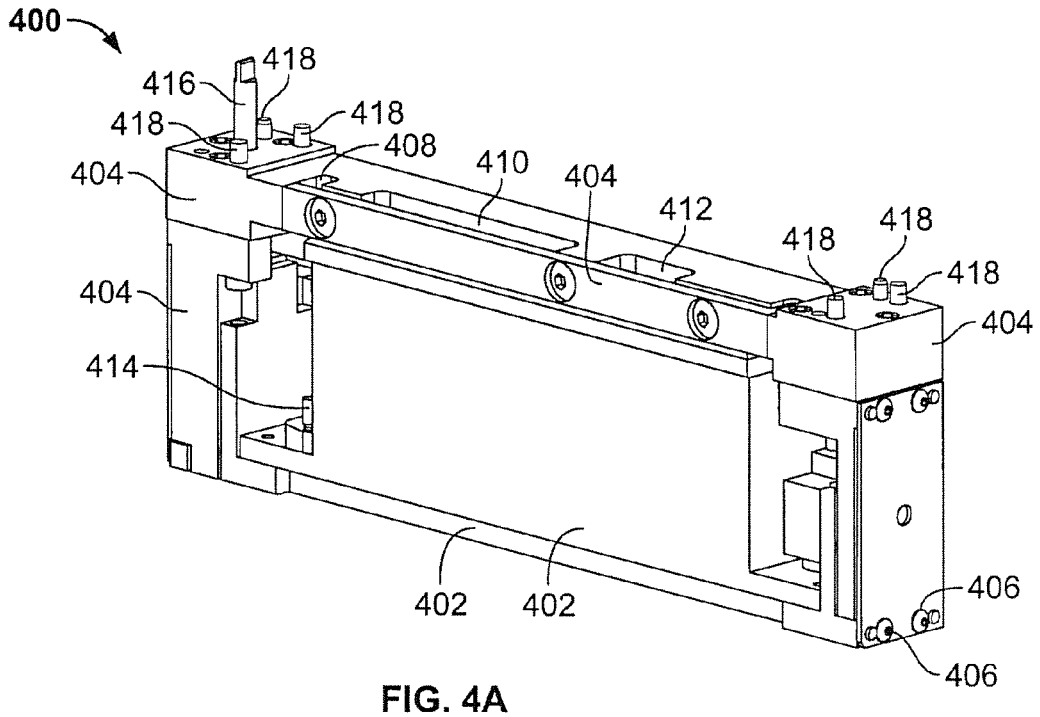
FIGS. 4A and 4B are isometric views of opposite sides of a mount that may be used in the printing system of FIG. 1.
Figure 4B:
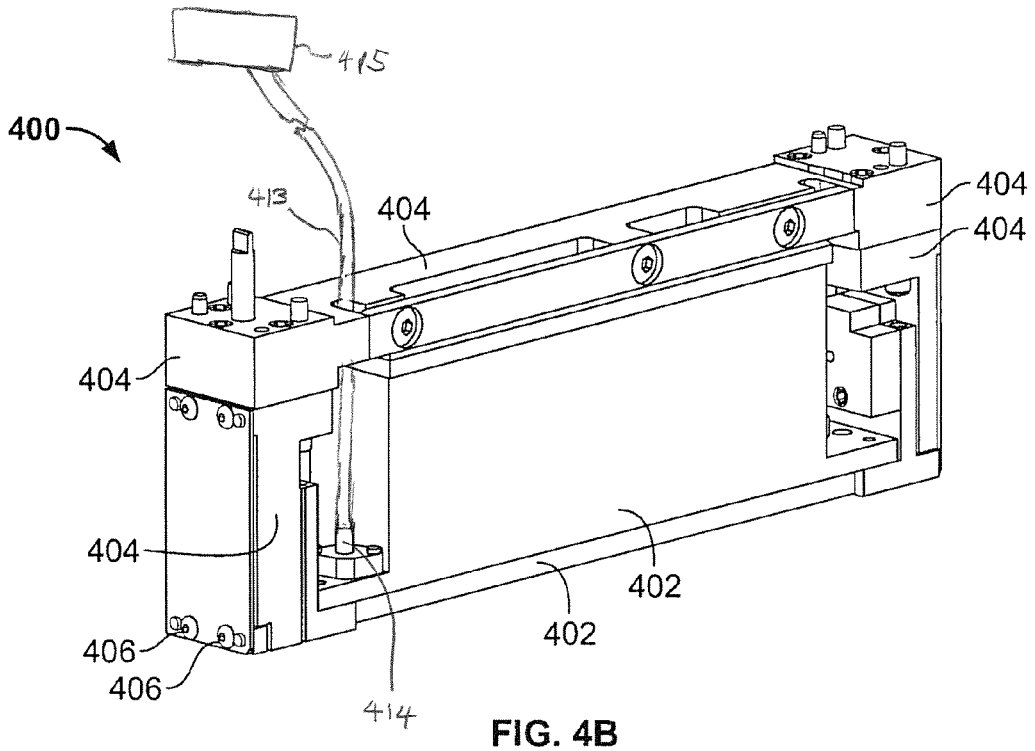

Referring to FIGS. 4A and 4B, a mount 400 has an inkjet cartridge 402 disposed therein and includes various frame members 404 that are secured to one another. The inkjet cartridge 402 is removably secured to the mount by screws 406. When secured to the carrier 300, apertures 408, 410, 412, and 419 are aligned with the slot 214 of the carrier 300. The aperture 408 allows a conduit 413 to pass therethrough such that the conduit 413 maybe secured to an inlet port 414 of the inkjet cartridge 402. Ink from a reservoir 415 external to the inkjet cartridge 402 may be supplied through such conduit 413 and to a reservoir internal to the inkjet cartridge 402. A data cable and a power cable may be passed through the apertures 410 and 412 to provide control data and power, respectively, to the inkjet cartridge 402. It should be apparent that the positions of the apertures 408, 410, 412, and 419 relative to one another may be varied in accordance with the features of the inkjet cartridge 402. Further, it should apparent that the mount 400 may include additional apertures to accommodate other connections or fewer apertures. The mount includes an alignment screw 416 that passes through one of the apertures 302 and allows an operator to adjust the position of the inkjet cartridge 402 relative to the position of the mount in the carrier 300. Datum surfaces 418 may be used to align the mount in the carrier 300 using the apertures 302 and 304.

Figure 5:
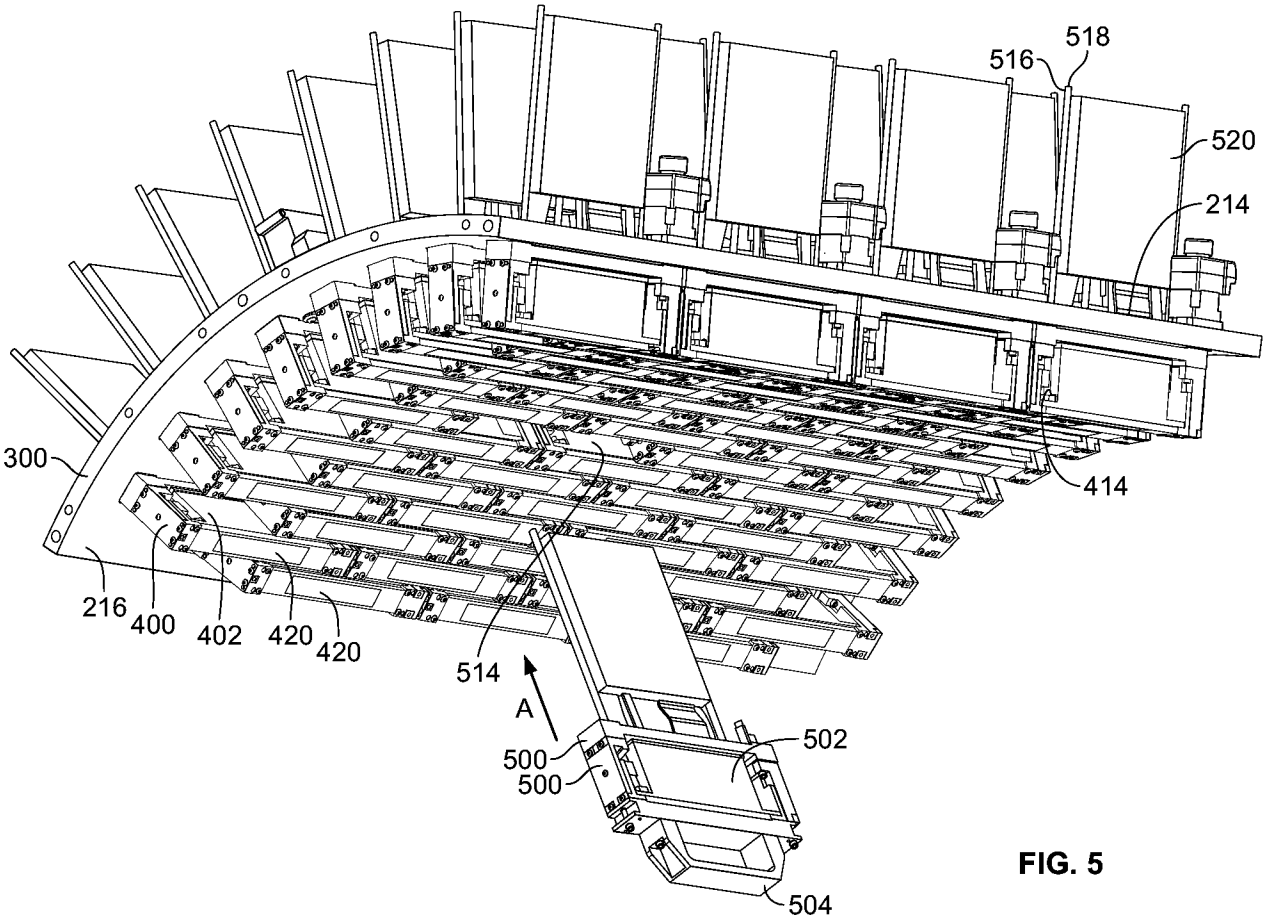
FIG. 5 is an isometric view of a carrier of the printing system of FIG. 1 that is populated with mounts and inkjet cartridges.

Referring to FIG. 5, the carrier 300 has the mounts 400 secured thereto and inkjet cartridges 402 secured to the mounts 400. In operation, the bottom surface 216 of the carrier 300 is positioned so that such surface faces the drum 208 and a receiving surface 120 is transported between the surface 216 and the drum 208. The inkjet cartridges 402 are positioned so that a nozzle plate 420 of each inkjet cartridge 402 faces towards the drum 208 and, therefore, the receiving surface 120. The nozzle plate 420 includes an array of apertures from which ink in the inkjet cartridge is ejected toward the receiving surface.

A mount 500 and inkjet cartridge 502 are similar or identical to the mounts 400 and inkjet cartridges 402, respectively, already secured to the carrier 300. In some cases, the inkjet cartridge 502 is secured to the mount 500 before the mount 500 is secured to the carrier 300 as described above. As should be apparent, that the mount 500 may instead be secured to the carrier 300 first and the inkjet cartridge 502 secured to the mount 500 thereafter. A handle 504 may be temporarily secured to the mount 500 and/or inkjet cartridge 502 to assist in positioning the mount 500 and/or inkjet cartridge 502 in a slot 514 of the carrier plate 300. The mount 500 may be secured to the carrier plate 300 as described hereinbefore.

In one embodiment, after the mounts 400 are secured to the carrier 300 and the inkjet cartridges 402 are disposed in such mounts, substantially all of each inkjet cartridge 402 extends inwardly beyond the bottom surface 216 of the carrier 300. In another embodiment, a portion of each or some of the inkjet cartridges 402 extends inwardly beyond the bottom surface 216. In still another embodiment, at least half of some or each of the inkjet cartridges 402 extends inwardly beyond the bottom surface 216.

A conduit 516 is guided through the slot 214 and the aperture 408 of the mount 400 and affixed to the inlet port 414 of the inkjet cartridge 402. An end 518 of the conduit 516 may be connected to an external ink supply (not shown).

A circuit board 520 is disposed atop the each mount 400, wherein such circuit board 520 includes a processor and supporting components that control the ejection of drops from the inkjet cartridge 402 disposed in such mount. The circuit board may be connected via a cable (not shown) to a data computer (not shown) that supplies data such as, for example, image data to the circuit board. Such data is analyzed by software and or firmware operating in the processor to determine when a drop should be ejected from the inkjet cartridge 402. Additional control signals, for example, those associated with the transport of the receiving surface 120 and/or rotation of the drum 208, may be supplied to the circuit board via the data cable. The processor may use the control signals and the data to determine the timing and frequency of drop ejection and the volume of ink in a drop.

Other embodiments of the invention including all the possible different and various combinations of the individual features of each of the foregoing described embodiments are specifically included herein.

INDUSTRIAL APPLICABILITY

The apparatus and method disclosed herein may be utilized to position and dispose inkjet cartridges and mounts therefor on a carrier of an imaging unit. Disposing the inkjet cartridges and mounts as described above enables the nozzle plates of the inkjet cartridges to be packed close to one another and provides sufficient space the for connecting such inkjet cartridges and mounts to cabling, fluid supply lines, and/or control circuitry. The inkjet cartridges may be packed so closely that the bottom portions thereof, that is, the portions of the inkjet cartridges farthest from the carrier plate, e.g., the nozzle plates, may be closely spaced or even touch one another in the direction of movement of the receiver surface. Further, disposing the inkjet cartridges and mounts in the manner described herein provides sufficient carrier material therebetween so that the structural integrity of the carrier is not compromised. Further, various modifications may be apparent to enhance the efficacy of mounting inkjet cartridges. Still further, the systems disclosed herein are easily scalable to be utilized with a wide variety of sizes, types, and configurations of printing systems.

It should be noted that some or all of the advantages noted above may be realized by an arrangement wherein a portion of each cartridge extends upwardly above the upper surface 218 of each carrier.

Numerous modifications to the present disclosure will be apparent to those skilled in the art in view of the foregoing description. Accordingly, this description is to be construed as illustrative only and is presented for the purpose of enabling those skilled in the art to make and use the disclosure and to teach the best mode of carrying out the same. The exclusive right to all modifications within the scope of this disclosure is reserved.

We claim:

1. A system for applying fluid to a receiver surface, comprising:

a carrier having a top surface, a bottom surface, and a slot, wherein the bottom surface of the carrier faces the receiver surface;

a mount positioned in the slot, wherein a portion of the mount extends inwardly from the bottom surface of the carrier;

an inkjet cartridge disposed in the mount; and a controller for causing the inkjet cartridge to eject fluid toward the receiver surface.

2. The system of claim 1, wherein the carrier is arcuate.

3. The system of claim 2, comprising a drum, wherein the receiver surface is transported between the drum and the bottom surface.

4. The system of claim 3, wherein rotation of the drum transports the receiver surface.

5. The system of claim 1, wherein the receiver surface is a web.

6. The system of claim 1, wherein the carrier includes a further slot.

7. The system of claim 6, comprising a further mount, wherein a further mount is disposed in the further slot.

8. The system of claim 7, comprising a further inkjet cartridge, wherein the further inkjet cartridge is disposed in the further mount.

9. The system of claim 8, wherein fluid from a common fluid reservoir is supplied to the inkjet cartridge and the further inkjet cartridge.

10. The system of claim 1, comprising a conduit associated with the inkjet cartridge, wherein the conduit supplies fluid from a fluid reservoir to the inkjet cartridge.

11. The system of claim 1, wherein the mount is secured to the carrier.

12. The system of claim 11, wherein the inkjet cartridge may be removed from the mount while the mount remains secured to the carrier.

13. The system of claim 1, wherein the inkjet cartridge is disposed in the mount before the mount is positioned in the slot.

14. The system of claim 1, wherein substantially all of the inkjet cartridge extends inwardly from the bottom surface of the carrier.

15. A method of printing on a receiver surface, comprising:

providing a carrier having a top surface, a bottom surface, and a slot, wherein the bottom surface of the carrier faces the receiver surface;

positioning a mount in the slot, wherein a portion of the mount extends inwardly from the bottom surface of the carrier;

disposing an inkjet cartridge in the mount; and operating the inkjet cartridge to eject a fluid toward the receiver surface.

16. The method of claim 15, comprising the further steps of rotating a drum and transporting the receiver surface between the drum and the bottom surface.

17. The method of claim 15, wherein the carrier comprises a further slot and the step of positioning the mount comprises the step of positioning a further mount in the further slot.

18. The method of claim 17, wherein the step of disposing the inkjet cartridge comprises the step of disposing a further inkjet cartridge in the further mount.

19. The method of claim 18, comprising the step of supplying the fluid to the inkjet cartridge and the further inkjet cartridge from a common fluid reservoir.

20. The method of claim 15, wherein the step of disposing the inkjet cartridge in the mount is undertaken before the step of positioning the mount.

21. The method of claim 15, wherein after the step of disposing the inkjet cartridge, substantially the entire inkjet cartridge extends inwardly from the bottom surface of the carrier.

22. The method of claim 15, comprising the further step of securing the mount to the carrier.

23. The method of claim 22, wherein the step of securing the mount to the carrier, comprises securing the mount to the bottom surface of the carrier.

24. A system for applying fluid to a receiver surface, comprising:

a carrier having a top surface, a bottom surface, and a slot, wherein the bottom surface of the carrier faces the receiver surface;

a mount positioned in the slot, wherein a portion of the mount extends inwardly from the bottom surface of the carrier;

an inkjet cartridge disposed in the mount;

a conduit associated with the inkjet cartridge, wherein the conduit supplies fluid from a fluid reservoir to the inkjet cartridge, and a first end of the conduit is coupled to the inkjet cartridge and a second end of the conduit extends outwardly from the top surface of the carrier; and a controller for causing the inkjet cartridge to eject fluid toward the receiver surface.

* * * * *